US008123525B2

(12) United States Patent
Beckmann

(10) Patent No.: US 8,123,525 B2
(45) Date of Patent: Feb. 28, 2012

(54) FIREARM SIMULATORS AND RELATED METHODS

(75) Inventor: Rudi Beckmann, Aichhalden-Rotenberg (DE)

(73) Assignee: Heckler & Koch, GmbH (DE)

( * ) Notice: Subject to any disclaimer, the term of this patent is extended or adjusted under 35 U.S.C. 154(b) by 1170 days.

(21) Appl. No.: 11/694,005

(22) Filed: Mar. 30, 2007

(65) Prior Publication Data

US 2007/0275354 A1 Nov. 29, 2007

Related U.S. Application Data

(63) Continuation of application No. PCT/EP2005/010226, filed on Sep. 21, 2005.

(30) Foreign Application Priority Data

Sep. 30, 2004 (DE) ..... 10 2004 047 628

(51) Int. Cl.
*F41A 33/00* (2006.01)

(52) U.S. Cl. ..... 434/18; 434/16

(58) Field of Classification Search ..... 434/18, 434/16, 24, 11; 89/1.816, 14.5, 191.01, 24, 89/28.2, 29

See application file for complete search history.

(56) References Cited

U.S. PATENT DOCUMENTS

| | | | | |
|---|---|---|---|---|
| 4,380,437 | A * | 4/1983 | Yarborough, Jr. | 434/18 |
| 4,480,999 | A * | 11/1984 | Witherell et al. | 434/18 |
| 5,857,854 | A * | 1/1999 | Kwalwasser | 434/18 |
| 6,682,350 | B2 * | 1/2004 | Kehl et al. | 434/18 |
| 6,739,324 | B2 * | 5/2004 | Hubert et al. | 124/72 |
| 6,820,608 | B2 * | 11/2004 | Schavone | 124/74 |
| 7,033,175 | B2 * | 4/2006 | Kunimoto | 434/18 |
| 7,306,462 | B2 * | 12/2007 | Metcalfe et al. | 434/18 |
| 2003/0084601 | A1 | 5/2003 | Kunimoto | |
| 2007/0275354 | A1 * | 11/2007 | Beckmann | 434/12 |

FOREIGN PATENT DOCUMENTS

| | | |
|---|---|---|
| DE | 3631262 | 3/1988 |
| EP | 1243889 | 9/2002 |
| EP | 1308689 | 5/2003 |

OTHER PUBLICATIONS

English translation of the Written Opinion of the International Preliminary Examination Report for international patent application serial No. PCT/EP2005/010226.

English translation of the International Search Report for international patent application serial No. PCT/EP2005/010226.

* cited by examiner

*Primary Examiner* — Alvin Hunter
*Assistant Examiner* — Alyssa Hylinski
(74) *Attorney, Agent, or Firm* — Hanley, Flight & Zimmerman, LLC

(57) ABSTRACT

Apparatus and methods are described for a weapon simulator. An example weapon simulator includes a pressure piston, which is couplable to a weapon, which acts to open a breech, and which is seated in a pressure cylinder. An example pressure piston includes a slider. The slider holds a pressure intake opening open and keeps one or more pressure outlet openings closed when the breech block is in a front-most position. In addition, the slider keeps the pressure intake opening closed and holds the one or more pressure outlet opening open when the breech block is in a rear-most position.

18 Claims, 3 Drawing Sheets

FIREARM SIMULATORS AND RELATED METHODS

RELATED APPLICATIONS

This patent is a continuation of International Patent Application Serial No. PCT/EP2005/010226, filed Sep. 21, 2005, which claims priority to German Patent Application 10 2004 047 628.4, filed on Sep. 30, 2004, both of which are hereby incorporated herein by reference in their entireties.

FIELD OF DISCLOSURE

This disclosure relates generally to firearms, and, more particularly, to firearm simulators and related methods.

BACKGROUND

Semi-automatic weapons, in particular fully automatic self-loading handheld firearms of larger caliber such as, for example, self-loading grenade launchers, require considerable practice before their tactical capabilities are fully realized. However, practicing with these weapons typically cannot occur with live ammunition at garrison training areas of military barracks because these training areas often are in densely populated areas and, thus, the required safety distance for protection cannot be observed. Military training areas that do offer sufficient safety distances for practicing with weapons are not widely prevalent and often require a substantial amount of travel to reach. Thus, in addition to the considerable expense of ammunition, the cost of practicing with weapons with live ammunition is also increased due to a greater expenditure in time, equipment and fuel to reach the isolated practice areas. Because most armies are chronically in need of additional funding, substitute training sessions in lieu of traveling to the isolated practice ranges must occur in order for the military to have proper training.

For accurate single shot weapons, there already exists devices that may be inserted into the weapons to fire a blank cartridge, which are typically used in small caliber shooting ranges such as, for example, those that are normally provided in barracks. Though the ballistics only rarely match the precise ballistics for the weapon, the blank cartridges are sufficient for the basic training of such a weapon. One known example is the training equipment for the Swedish recoilless rifle, the "Carl Gustav."

It is different with large caliber fully automatic weapons such as, for example, a self-loading grenade launcher. With these weapons, the movement and operation of the breech is so extensive that some habituation or accommodation time is required until precise bursts of fire can actually be fired. In this habituation time, the confidence of a marksman, who is paying greater attention to the discharge of weapon, may be compromised because he or she may believe that operating the weapon to achieve a burst of fire is futile. Then, in later actions when firing of the weapon has been commanded, the marksman may then mis-operate or uncontrollably operate the weapon with "fear shots." Though, in actuality, the weapon can definitely be held and aimed during a burst of fire. As a result, not only is the weapon not used in full measure, it is used in vain.

One known weapon simulator is described in U.S. Pat. No. 4,480,999, which includes a butt that replaces the barrel of a self-loading pistol. The butt drives back a breech, however the pistol described herein has additional elements that must be exchanged or built on so that the weapon simulator functions.

More specifically, the weapon requires a valve arrangement controlled by a long control rod, which replaces a short spring guide of the firing pin spring.

Another known weapon simulator is described in German Patent DE 36 31 262 A1, which shows a sport pistol whose upper part is completely interchangeable. In addition, a $CO_2$ cartridge is seated in the interchangeable upper part. The $CO_2$ cartridge drives a pressure piston that is provided in place of the breech.

DETAILED DESCRIPTION

Throughout this patent, directional and orientational terms such as, for example, "front," "back," "up," "down," "above," "below," "right," and "left" are referenced from the standpoint of a marksmen holding a weapon in the firing position, wherein the direction of fire is along the horizontal axis of the bore, i.e., the axis of the barrel. The normal axis is vertical.

The description relates to an example weapon simulator for installation into an example firearm such as a self-loading firearm. In particular, the example firearm described herein is an unlocked, fully automatic, large caliber, portable self-loading firearm such as, for example, a grenade launcher.

Figure 1:
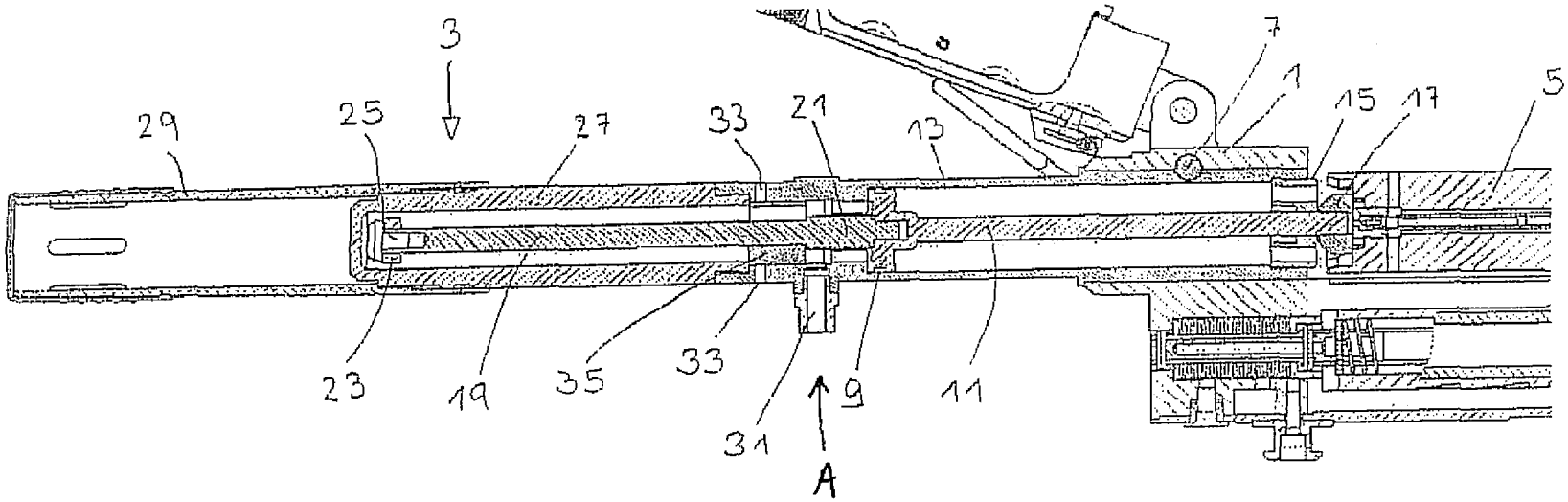
FIG. 1 illustrates a longitudinal cross-section of front portion of an example weapon with an example simulator, with the weapon facing toward the left.

FIG. 1 shows a front end of an example weapon, i.e., an example grenade launcher that has a weapon case 1 and includes a tubular simulator 3 that is coupled to the weapon 2 in place of a barrel by means of a bolt 7. After removal of the bolt 7 the simulator 3 may be pulled out toward the front (i.e., to the left in FIG. 1) and may be replaced by a barrel (not shown).

The simulator 3 includes an outer, oblong cylinder 13 in which a piston 9 rests flush against the inside wall of the cylinder 13. The piston 9 may be moved to and fro. A piston rod 11 is integrally connected to the piston 9 and extends from the piston 9 to the weapons case 1 and a penetrating a guide 15, which is installed on the weapon-side end of the cylinder 13. The piston rod 11 ends on the side of the guide 15 away from the piston 9 in a plastic buffer 17, which is supported on a breech of the weapon.

The example weapon is a self-loading grenade launcher firing from an open bolt, so that the breech block 5 is only in the front-most position when a trigger (not shown) has been pulled. However, in this example with the simulator 3, no active cartridge is located in a magazine (not shown). When the weapon operates with sustained or undisturbed firing with live ammunition, the breech block 5 occupies the front-most location only briefly, i.e., when the breech block 5 has pulled the cartridge from the magazine and ignited the cartridge. The position of the breech block 5 may be between the position in FIG. 1 and a position behind a locking engagement of the trigger. With the simulator 3 coupled to the weapon, the path covered by the piston 9 may correspond, i.e., align with that of the breech block 5.

At the other side of the piston 9 away from the weapon casing 1 (i.e., toward the left in FIG. 1), a control rod 19 is fastened in the piston 9. The piston 9, the control rod 19 and the piston rod 11 are coaxial with the axis of the bore of the weapon.

At the end adjacent to the piston 9, the control rod 19 has a thickened section 21. At the other end, the control rod 19 has a central end screw 25 (coaxial to the axis of the bore), which holds a stop ring 23 that may be made of a soft plastic.

The path of motion of the control rod 19 is surrounded and protected by a cap 27, on whose front end a barrel mockup 29 is coupled. The barrel mockup 29 is adapted to be slipped onto the actual barrel muzzle. The rear end the cap 27 is seated in the front end of the cylinder 13, while the thickened section 21 of the control rod 19 is located in the front-most section of the cylinder 13. An air intake opening 31 emptying into the cylinder 13 is also provided there. Between the air intake opening 31 and front end of the cylinder 13, the wall of the cylinder 13 is penetrated by a belt of air outlet openings 33 (i.e., one or more). The rear end of the cap 27 lies shortly before the air outlet openings 33 and has a smaller interior diameter than the cylinder 13. The air inlet opening 31 may be referred to throughout this document as the pressure inlet opening 31 as well. In addition, the air outlet openings 33 may be referred to throughout this document as the pressure outlet openings 33.

Figure 2:
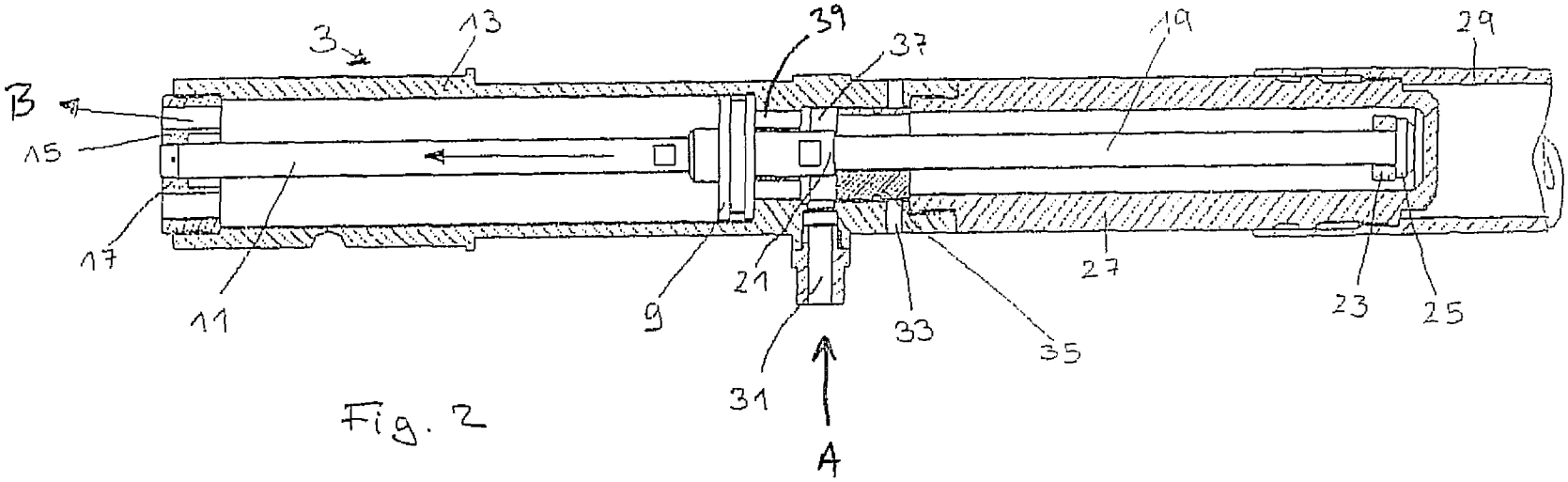
FIG. 2 illustrates an enlarged view of a portion of the example weapon of FIG. 1 facing toward the right prior to the impact of compressed air.

In addition, a slider 35 is provided which fits at the inside wall of the cylinder in a sealing but movable manner. The slider 35 is penetrated by the control rod 19 and parallel to the control rod 19 though there is at least one air hole interspersed. In the position shown in FIGS. 1 and 2, the slider 35 is in contact with the weapon-side end of the cap 27 and the muzzle-side end of the thickened section 21. Further, the slider 35 covers and closes the air outlet openings 33, while releasing the air intake opening 31. A separate slider borehole 37 (FIG. 2) is provided in the cylinder 13 for the slider 35, the slider borehole has a diameter smaller than that of the borehole of the cylinder 13 for the piston 9 and runs coaxially to the borehole of the cylinder. Between the slider borehole 37 and borehole of the cylinder 13, a short section borehole 39 is situated that has the smallest diameter among the three.

The penetrating guide 15 on the rear end of the cylinder 13 is bored through so that air can enter and exit. The air in the inside of the cylinder 13 has no special excess pressure on this side of the piston 9. When compressed air flows into the air intake 31 in operation (arrow A, FIGS. 1 and 2), then the air flows through the borehole(s) in the slider 35 and strikes the piston 9 at the front end of the piston 9. The piston 9 then presses rearward, along with the piston rod 11 and the plastic buffer 17, against the breech block 5, which is pressed in the opposite direction, i.e., forward, by the weapon-specific breech-closing spring arrangement (not shown). When the air pressure rises, the piston 9, along with the piston rod 11 and plastic buffer 17, move the breech block 5 to the rear until the stop ring 23 on the front end of the control rod 19 strikes against the slider 35 and presses the slider 35 to the rear. The slider 35 now closes the air intake opening 31 and strikes on the end of the slider borehole 37. In the process, the slider 35 releases the air outlet openings 33 (arrows C, FIG. 3). The slider 35 is now situated in the position of FIG. 3, in which the breech block 5 is brought to the rear-most position.

Figure 3:
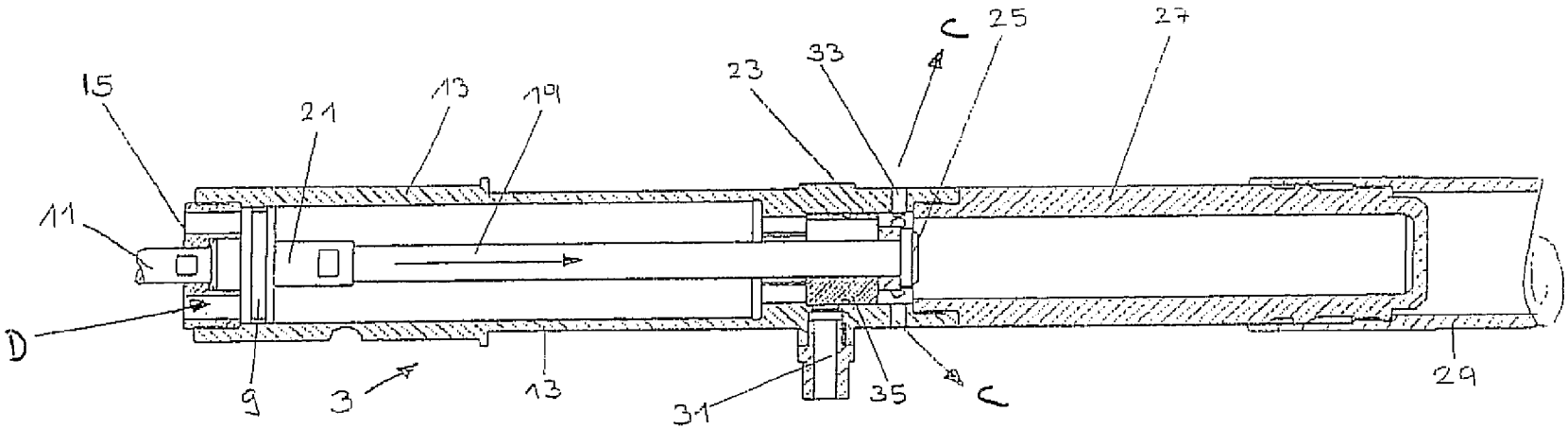
FIG. 3 illustrates an enlarged view of a portion of the example weapon of FIG. 1 facing toward the right wherein an example simulator has been impacted with compressed air and is ready to simulate the firing of rounds.

If the trigger (not shown) now is pulled, then the breech block 5 runs practically freely to the front because the released air in the cap 27 is pressed through the air outlet openings 33 (arrows C, FIG. 3), and air in the cylinder 13 is freely suctioned in through the borehole(s) in the guide 15 (arrow D, FIG. 3). The particular sizes of the air outlet openings 33 determine the simulated "firing speed". The piston 9 moves to the front until the thickened section 21 meets the slider 35 and pushes the slider 35 to the front. Movement of the slider 35 toward the front closes the air outlet openings 33 once more and opens the air intake opening 31. As long as the trigger remains pulled (e.g., with sustained firing weapons), and as long as compressed air is available, the weapon breech block 5 now moves to and fro as in the case of actual fire. When the trigger is released then, as in the case of actual fire, the breech block 5 remains in the rear position, i.e., the position of readiness to fire.

Operation of the simulator 3 may be refined by a dosage apparatus which automatically interrupts the compressed air supply after a specified number of "shots" such as, for example, a number of shots corresponding to a cartridge belt or a magazine.

Also, with the exception of removal of the barrel and installation of the simulator 3—activities familiar to marksmen—no further alterations and no changes to the weapon itself are necessary. That is, the example simulator 3 described herein may be added to a weapon without altering the original operational elements of the weapon. Furthermore, the example simulator 3 permits a marksman to practice firing shots (even in interior spaces) without the need for mounting yet additional elements on to the weapon.

As described above, the weapon simulator 3 may be coupled to a self-loading firearm, in particular an unlocked, fully automatic, large caliber, portable self-loading firearm. The simulator may be coupled to the weapon by any means such as, for example, mounting the simulator 3 on or inserting the simulator 3 in the weapon. The firearm includes the pressure piston 9, which may be coupled to the weapon and act on the breech block 5 to open the breech. The pressure piston is coupled to the pressure cylinder 13, which contains the slider 35 that holds the pressure intake opening 31 open and keeps the pressure outlet openings 33 closed when the breech block 5 is in the front-most position. Further, when the breech block 5 is in the rear-most position, the slider 35 closes the pressure intake opening 31 and keeps the pressure outlet openings 33 open.

The pressure piston 9 acts on the weapon like a fired cartridge to, for example, recoil the breech and the associated breechblock 5, and, with an unlocked weapon, accelerate the breech block 5 toward opening when a shot has been simulated. In some examples, the piston 9 may travel in a path that a gas piston would (during the firing of live ammunition) to recoil the breech block 5.

The pressure piston 9 may be impacted with compressed air, but other pressure media such as, for example, $CO_2$ also may be used. Compressed air can be taken from reservoirs, in particular containers (not shown) that serve as refillable reservoirs. The containers may be mounted on the weapon in place of magazines or the like. In addition, the containers also may be remote and may be coupled to the weapon via an extension cord through which the air or other gas may flow, i.e., a line (e.g., compressed air lines in workshops or motor vehicles). These air or other gas compression sources are sufficient for use with the example simulator 3 and weapon because, for example with the self-loading grenade launcher, only about 10 bars of pressure are required.

The pressure piston 9 may be coupled to the weapon by, for example, installing the piston 9 in the barrel, which has the advantage that the original barrel can be used. In other examples, the piston 9 may be seated in the pressure cylinder 13. The pressure cylinder 13 may be mounted on the weapon where movement of the piston 9 is necessary for operation of the breech block 5. For example, the pressure cylinder 13 may be integrated in a throttle control rod of a gas operated rifle in place of the gas cylinder of the weapon. Then, the pressure piston 9 exhibits the function of a gas piston.

In addition, however, the pressure cylinder 9 may include the slider 35, as described above. The slider 35 holds the pressure intake opening 31 open and keeps the pressure outlet openings 33 closed when the breech block 5 is in the front-most position. In addition, when the breech block 5 is in the rear-most position closes, the slider 35 keeps the pressure intake opening 31 closed and the pressure outlet openings 33 open, as described above. Thus, in the case of a weapon firing from an open bolt (i.e., a weapon in which an open breech is released with the trigger for firing such as, for example, with a conventional machine gun), full function of the weapon is guaranteed with the simulation of sustained and/or single-shot fire. Further, only the operational elements of the weapon (e.g., safety, trigger, etc.) are required, while the slider 35 in the pressure cylinder 13 is carried along by the pressure piston 9 so that no additional equipment is required. Naturally, the pressure supply will normally have additional elements such as, for example, a serially connected safety valve. The serially connected safety valve may be set, for example, to a desired number of shots to be simulated such as, for example, the same number of shots equivalent to those contained in a normal or standard magazine or belt. As such, the simulating weapon would not able to fire an additional shot after the number of shots that a normal magazine or a normal has is exceeded.

The above-described safety feature also may control the slider 35 directly so that the slider 35 ultimately only forms an end valve in front of the pressure cylinder 13. However, the slider 35 also may be controlled by the pressure piston 9. Thus, there is no requirement for a separate control system for the slider 35 but, rather, the slider 35 ultimately may cause a weapon, for example a weapon firing from an open bolt, to control itself via the pressure piston 9. Thus, the weapon behaves exactly as if the weapon were being operated with live ammunition, where ultimately nothing more is required than that the pressure cylinder 9 and the slider 35 used in place of the barrel and controlled with compressed air or another pressure medium.

In some examples, the pressure cylinder 13 has the shape similar or the same as the barrel of the weapon and may be inserted into the weapon, or otherwise coupled to the weapon, in place of the barrel (as described above). In this example, the pressure piston 9 acts against the breech block 5. As a result, a pressure piston with an oversize caliber diameter be used, which reduces the pressure in such a piston. In addition, the barrel is spared, which could be scratched in usage as a pressure cylinder 13. Furthermore, the pressure cylinder 13 may lack ridges and/or grooves on its interior surface to decrease any compromise or impairment of the function of the pressure piston 9.

The pressure piston 9 has at least one pressure intake opening 31 and pressure outlet opening 33, which can be arranged within the weapon to avoid detracting from the appearance of the weapon. However, in some examples, such as with the above-described pressure cylinder 13 that has one pressure intake opening 31 and at least one pressure outlet opening 33, all pressure intake and outlet openings 31 and 33 are arranged outside of the weapon, i.e., beyond the section of the case 1 of the weapon that holds the breech 5. In this example, the function of the weapon that includes the simulator 3 is not compromised or otherwise impaired by the inclusion of the simulator 3 by, for example, any gas flows because no gas lines empty into the weapon itself. Thus, it is possible to change the weapon rapidly between inclusion of the simulator 3 and normal operation without any major structural intervention, which allows the typical behavior of any single weapon to be experienced even when the weapon is operated with the simulator 3. Consequently, an individual weapon may be tested in simulation easily and frequently so that it is obvious if there is a problem with the weapon such as, for example, wear, incorrect assembly, etc., even before a live shot is fired.

As stated above, the present description also relates not only to the weapon simulator 3, but also to a portable firearm, in particular the above-described unlocked, fully automatic self-loading grenade launcher that includes a barrel, which is replaced by the pressure cylinder 13, as described above. Because, as noted herein, the barrel has been replaced, the barrel may later be re-coupled to the weapon and the weapon remains fully functional. Thus, a marksman does not need, for example, additional training equipment. The pressure cylinder 13, which is used in place of the barrel in the simulation operation, may be produced easily and cheaply and may be provided with a muzzle silencer (not shown) so that the weapon provided with simulator 3 does not differ optically from the live weapon.

Further, with the illustrated example weapon, a marksman may test the weapon at, for example, a military training area or a firing training area to get a first impression of the function of the weapon while the pressure cylinder 13 is coupled to, for example, a compressed air conduit of a truck or other source. With the same weapon the marksmen can continue their training with live rounds only minutes later after replacement of the simulator with a barrel. Further, after repair of the weapon, it is also possible, with attachment of the simulator 3, to perform function tests. Thus, live ammunition may be saved for use only at the very end of such testing. Therefore, it is possible to considerably reduce both the costs and expenditure of time associated with the training and/or repair. Furthermore, frequent trainings with the weapon can be "shot" (i.e., occur) indoors or in populated areas because the noise generated is slight, and no projectiles leave the weapon.

The above-described benefits are appreciable with many different weapons including, for example, the portable self-loading grenade launcher, as described above. The operation of the grenade launcher with live ammunition requires a spacious military training area. In addition, operation with blank ammunition still requires a shooting range and also, sustained fire operation cannot be practiced with small caliber blank ammunition with special liners.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A weapon simulator comprising:

a pressure cylinder removably couplable to a fully automatic weapon; and a pressure piston seated in the pressure cylinder, the pressure piston to open a breech, wherein the pressure piston includes:

a control rod; and a slider coupled to the control rod, wherein the slider holds a pressure intake opening open and keeps one or more pressure outlet openings closed when a breech block is in a front position, and wherein the slider keeps the pressure intake opening closed and holds the one or more pressure outlet opening open when the breech block is in a rear position.

2. A weapon simulator as defined in claim 1, wherein the firearm is unlocked, large caliber, and portable.

3. The weapon simulator as defined in claim 1, wherein the pressure cylinder has a shape similar to the shape of a barrel of the weapon, and wherein the pressure cylinder is couplable to the weapon in place of the barrel.

4. The weapon simulator as defined in claim 1, wherein the pressure cylinder includes the pressure intake opening and the one or more pressure outlet openings, wherein the pressure intake opening and the one or more pressure outlet openings are outside of a case section of the weapon, wherein the case section of the weapon includes the breech.

5. The weapon simulator as defined in claim 1, wherein the slider is controlled by the pressure piston.

6. The weapon simulator as defined in claim 1, wherein the size of the pressure outlet openings determines a simulated firing speed.

7. The weapon simulator as defined in claim 1, wherein the control rod is fastened to the pressure piston and the control rod and the pressure piston are coaxial with a longitudinal axis of a bore of the weapon.

8. The weapon simulator as defined in claim 1, wherein the pressure piston rests flush against an inside wall of the pressure cylinder.

9. The weapon simulator as defined in claim 1 wherein the slider is penetrated by the control rod.

10. The weapon simulator as defined in claim 1, wherein the control rod has a thickened section adjacent to the pressure piston.

11. The weapon simulator as defined in claim 1 further comprising an end cap coupled to the pressure cylinder and a barrel mockup coupled to the end cap.

12. The weapon simulator as defined in claim 1 wherein the slider is parallel to the control rod.

13. A portable fully automatic firearm comprising a weapon simulator, wherein the weapon simulator comprises:

a pressure cylinder removably couplable to the firearm; and a pressure piston seated in the pressure cylinder, the pressure piston to open a breech, and which is seated in a pressure cylinder, wherein the pressure piston includes:

a control rod; and a slider coupled to the control rod, wherein the slider holds a pressure intake opening open and keeps one or more pressure outlet openings closed when a breech block is in a front position, and wherein the slider keeps the pressure intake opening closed and holds the one or more pressure outlet opening open when the breech block is in a rear position.

14. The portable firearm defined in claim 13, wherein the firearm is unlocked, large caliber, and portable.

15. The portable firearm as define in claim 13, wherein the pressure cylinder has a shape similar to the shape of a barrel of the firearm, and wherein the pressure cylinder is couplable to the firearm in place of the barrel.

16. The portable firearm as define in claim 13, wherein the pressure cylinder includes the pressure intake opening and the one or more pressure outlet openings, wherein the pressure intake opening and the one or more pressure outlet openings are outside of a case section of the firearm, wherein the case section of the firearm includes the breech.

17. The portable firearm as define in claim 13, wherein the slider is controlled by the pressure piston.

18. A method of simulating the firing of a fully automatic weapon, the method including:

removably coupling a pressure cylinder to the weapon in place of a barrel;

using a pressure piston, which is seated in the pressure cylinder to open a breech;

using a slider coupled to a control rod of the pressure piston to hold a pressure intake opening open and keep one or more pressure outlet openings closed when the breech block is in a front position; and using the slider to keep a pressure intake opening closed and hold one or more pressure outlet openings open when the breech block is in a rear position.

* * * * *